US009087425B2

(12) United States Patent
Park et al.

(10) Patent No.: US 9,087,425 B2
(45) Date of Patent: Jul. 21, 2015

(54) CIRCULATION-TYPE BANKNOTE/CHECK DEPOSIT/WITHDRAWAL APPARATUS USING LATERAL DEPOSIT/WITHDRAWAL SCHEME AND METHOD OF HANDLING BANKNOTES AND CHECKS APPLIED THERETO

(71) Applicant: Nautilus Hyosung Inc., Seoul (KR)

(72) Inventors: Chang Ho Park, Gunpo-si (KR); Young Chul Lee, Anyang-si (KR); Jin Young Hwang, Seoul (KR); Jun Young Kim, Gyeonggi-do (KR); Jong Seong Park, Anyang-si (KR); Dong Yeol Lee, Seoul (KR)

(73) Assignee: NAUTILUS HYOSUNG INC., Seoul (KR)

( * ) Notice: Subject to any disclaimer, the term of this patent is extended or adjusted under 35 U.S.C. 154(b) by 0 days.

(21) Appl. No.: 14/132,732

(22) Filed: Dec. 18, 2013

(65) Prior Publication Data

US 2015/0114794 A1 Apr. 30, 2015

(30) Foreign Application Priority Data

Oct. 25, 2013 (KR) ..... 10-2013-0127692

(51) Int. Cl.

| | |
|---|---|
| ***G07D 7/12*** | (2006.01) |
| ***G07D 11/00*** | (2006.01) |
| ***B65H 9/00*** | (2006.01) |
| ***G07D 7/16*** | (2006.01) |

(52) U.S. Cl.

CPC ..... *G07D 7/128* (2013.01); *B65H 9/00* (2013.01); *G07D 7/168* (2013.01); *G07D 11/0018* (2013.01); *G07D 11/0027* (2013.01); *G07D 11/0084* (2013.01)

(58) Field of Classification Search

CPC ... G07D 11/00; G07D 11/0027; G07D 13/00; G07D 2211/00; B65H 7/10; B65H 7/12

USPC ..... 194/206, 207, 342, 344, 346; 209/534; 271/227, 241, 250, 261; 250/271, 250/559.01, 559.05, 559.07; 382/135, 137

See application file for complete search history.

(56) References Cited

U.S. PATENT DOCUMENTS

| | | | | |
|---|---|---|---|---|
| 5,662,202 | A * | 9/1997 | Suris | 194/206 |
| 8,695,776 | B2 * | 4/2014 | Cha et al. | 194/206 |
| 2002/0011431 | A1 * | 1/2002 | Graef et al. | 209/534 |
| 2011/0005892 | A1 * | 1/2011 | Ohishi | 194/206 |

FOREIGN PATENT DOCUMENTS

| | | | |
|---|---|---|---|
| DE | 10 2011 000 783 | A1 | 8/2012 |
| DE | 10 2011 000 785 | A1 | 8/2012 |

OTHER PUBLICATIONS

European Patent Office, Search Report and Opinion, European Patent Application No. 13197843.9, Feb. 5, 2015, seven pages.

* cited by examiner

*Primary Examiner* — Mark Beauchaine
(74) *Attorney, Agent, or Firm* — Fenwick & West LLP

(57) ABSTRACT

The present invention relates to a circulation-type banknote/check deposit/withdrawal apparatus using a lateral deposit/withdrawal scheme and a method of handling banknotes and checks applied thereto, wherein banknotes and checks of various sizes can be deposited and withdrawn through a single deposit/withdrawal unit; a carrying path is configured to carry the banknotes and checks deposited through the deposit/withdrawal unit in a lateral direction; and the carrying path is provided thereon with a medium alignment unit for aligning the carrying position on the carrying path of the banknotes and checks being carried thereon, so that the banknotes and checks can be carried in a state where the banknotes and checks are aligned with a predetermined alignment position on the carrying path by the medium alignment unit, and stacked into respective corresponding cassettes.

17 Claims, 9 Drawing Sheets

CIRCULATION-TYPE BANKNOTE/CHECK DEPOSIT/WITHDRAWAL APPARATUS USING LATERAL DEPOSIT/WITHDRAWAL SCHEME AND METHOD OF HANDLING BANKNOTES AND CHECKS APPLIED THERETO

CROSS-REFERENCE TO RELATED APPLICATIONS

This application claims the benefit of Korean Patent Application No. 10-2013-0127692, filed on Oct. 25, 2013, which is incorporated by reference herein in its entirety. The present

BACKGROUND OF THE INVENTION

1. Field of the Invention

The present invention relates to a circulation-type banknote/check deposit/withdrawal apparatus using a lateral deposit/withdrawal scheme and a method of handling banknotes and checks applied thereto, and more particularly, to a circulation-type banknote/check deposit/withdrawal apparatus using a lateral deposit/withdrawal scheme and a method of handling banknotes and checks applied thereto, wherein banknotes and checks of various sizes can be deposited and withdrawn through a single deposit/withdrawal unit; a carrying path is configured to carry the banknotes and checks deposited through the deposit/withdrawal unit in a lateral direction; and the carrying path is provided thereon with a medium alignment unit for aligning the carrying position on the carrying path of the banknotes and checks being carried thereon, so that the banknotes and checks, which have been deposited through the deposit/withdrawal unit and are being carried in the lateral direction, can be carried in a state where the banknotes and checks are aligned with a predetermined alignment position on the carrying path by the medium alignment unit, and stacked into respective corresponding cassettes, thereby optimizing the sizes of check and banknote cassettes based on the sizes of corresponding media (banknotes and checks), enhancing the carrying efficiency of the media on the carrying path by using the lateral deposit scheme, and increasing the processing speed of the media while reducing the volume of the deposit/withdrawal apparatus.

2. Description of the Related Art

Generally, an automated teller machine (ATM) is an automation device for financial services that is capable of assisting basic financial services such as deposit or withdrawal of banknotes or checks regardless of place and time without a bank clerk and is configured to automatically perform a financial transaction such as deposit or withdrawal of banknotes or checks by using a medium such as a card or bankbook.

Such an ATM may be operated during an extended time even after a bank window has been closed, or may be installed to be manlessly operated in a store such as a department store or supermarket. Thus, the number of installed ATMs tends to be rising.

Further, in addition to an ATM for processing deposit and withdrawal of banknotes, an ATM for processing deposit and withdrawal of both banknotes and checks at the same time appears recently, thereby improving customer's convenience in view of financial transactions.

The ATM as described above has a bankbook processing unit and a card/transaction-receipt processing unit to support a financial transaction using a medium such as the bankbook or card, and further has an input/output unit for inputting and displaying transaction contents and a deposit/withdrawal apparatus for processing deposit and withdrawal of banknotes and checks.

Here, the deposit/withdrawal apparatus is a core component in the ATM, which requires a carrying mechanism for carrying banknotes and checks and a high level of discrimination identification and processing technology for discriminating and receiving the banknotes and checks to be carried.

FIGS. 1 and 2 are views showing an ATM and a banknote/check deposit/withdrawal apparatus provided therein according to the related art.

In the conventional ATM as shown in FIG. 1, a banknote deposit unit 1 for allowing banknotes to be deposited into the ATM, a banknote withdrawal unit 2 for allowing banknotes to be withdrawn from the ATM, and a check deposit unit 3 for allowing checks to be deposited into the ATM are provided within the ATM while a banknote insertion unit 4, banknote discharge units 5, and a check deposit unit 6 are provided in a customer reception area of the ATM. Accordingly, since the banknotes or checks should be deposited and withdrawn through the respective insertion and discharge units when a customer utilizes the ATM, there is a problem of inconvenience in use. Further, since three units should be operated in the ATM, there are disadvantages of increase in the volume of the apparatus and deterioration of the operational efficiency as well as a problem of frequent replenishment of banknotes to be withdrawn due to inability to circulate the banknotes.

Accordingly, an ATM with an enhanced operational efficiency has been used recently, wherein as shown in FIG. 2, the ATM includes a banknote deposit/withdrawal unit 11 by which banknotes are deposited and withdrawn and a check deposit/withdrawal unit 12 by which checks are deposited and withdrawn, further has a customer reception area provided with a check deposit/withdrawal unit 13 through which the checks are inserted and a banknote deposit/withdrawal unit 14 through which the banknotes are inserted, and is also configured to be capable of circulating banknotes, thereby offering customer's convenience.

However, the ATM including two deposit/withdrawal units as described above also has the following disadvantages: if a customer wishes to deposit both banknotes and checks at the same time through the ATM, there is cumbersomeness since the checks should be inserted through the check deposit/withdrawal unit 13 while the banknotes should be inserted through the banknote deposit/withdrawal unit 14; and separately providing a carrying path for carrying the checks and a carrying path for carrying the banknotes mainly contributes to increases in the production costs and volume of the ATM.

SUMMARY OF THE INVENTION

Accordingly, the present invention is conceived to solve the aforementioned problems in the related art. An object of the present invention is to provide a circulation-type banknote/check deposit/withdrawal apparatus using a lateral deposit/withdrawal scheme and a method of handling banknotes and checks applied thereto, wherein banknotes and checks of various sizes can be deposited and withdrawn through a single deposit/withdrawal unit; a carrying path is configured to carry the banknotes and checks deposited through the deposit/withdrawal unit in a lateral direction; and the carrying path is provided thereon with a medium alignment unit for aligning the carrying position on the carrying path of the banknotes and checks being carried thereon, so that the banknotes and checks, which have been deposited through the deposit/withdrawal unit and are being carried in the lateral direction, can be carried in a state where the banknotes and checks are aligned with a predetermined alignment position on the carrying path by the medium alignment unit, and stacked into respective corresponding cassettes, thereby optimizing the sizes of check and banknote cassettes based on the sizes of corresponding media (banknotes and checks), enhancing the carrying efficiency of the media on the carrying path by using the lateral deposit scheme, and increasing the processing speed of the media while reducing the volume of the deposit/withdrawal apparatus.

According to an aspect of the present invention for achieving the objects, there is provided a banknote/check deposit/withdrawal apparatus for depositing and withdrawing banknotes and checks using a lateral deposit/withdrawal scheme, comprising: a deposit/withdrawal unit for receiving banknotes and checks inserted thereinto or discharging banknotes to be withdrawn; a medium discrimination unit for reading out and discriminating images of the banknotes and checks; a temporary storage unit for temporarily storing the deposited banknotes and checks until a transaction thereof is established; check cassette for stacking the deposited checks; a plurality of banknote cassettes for stacking the banknotes based on the respective types of the banknotes; a carrying path for laterally carrying the banknotes and checks to be deposited or withdrawn along a predetermined course; and a medium alignment unit provided on the carrying path so as to align carrying positions of the laterally carried banknotes and checks on the carrying path with a predetermined alignment position.

BRIEF DESCRIPTION OF THE DRAWINGS

The above and other objects, features and advantages of the present invention will become apparent from the following description of preferred embodiments given in conjunction with the accompanying drawings, in which.

DESCRIPTION OF THE PREFERRED EMBODIMENT

Hereinafter, preferred embodiments of the present invention will be described in detail with reference to the accompanying drawings. However, the present invention is not limited to the embodiments described below unless other embodiments depart from the subject matter of the invention.

Figure 1:
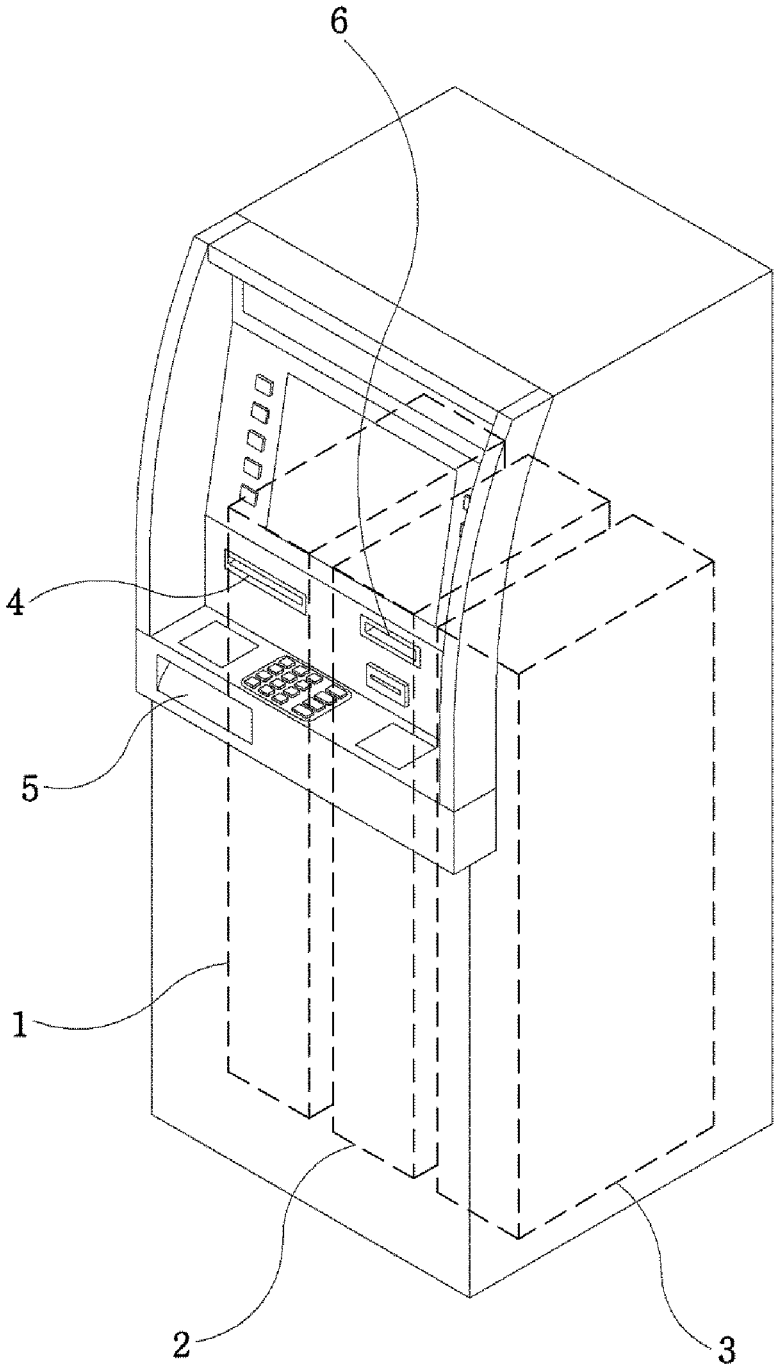
FIGS. 1 and 2 are views showing an ATM and a deposit/withdrawal apparatus provided therein according to the related art.
Figure 2:
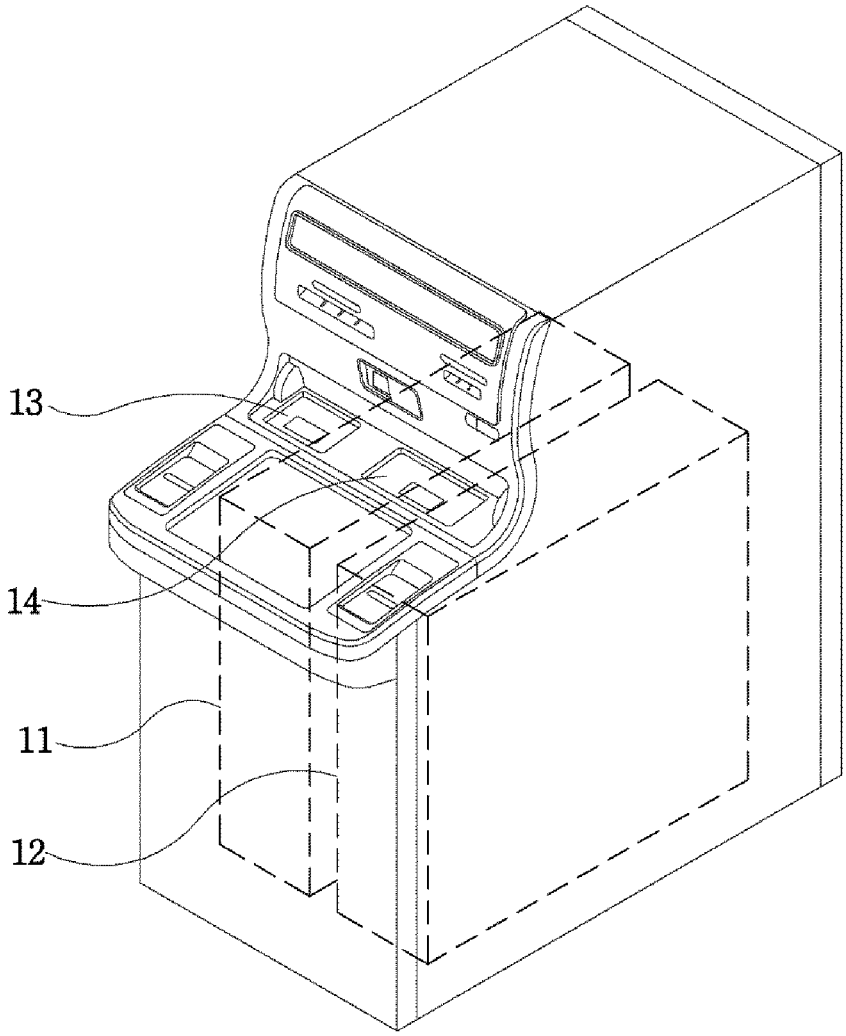
Figure 3:
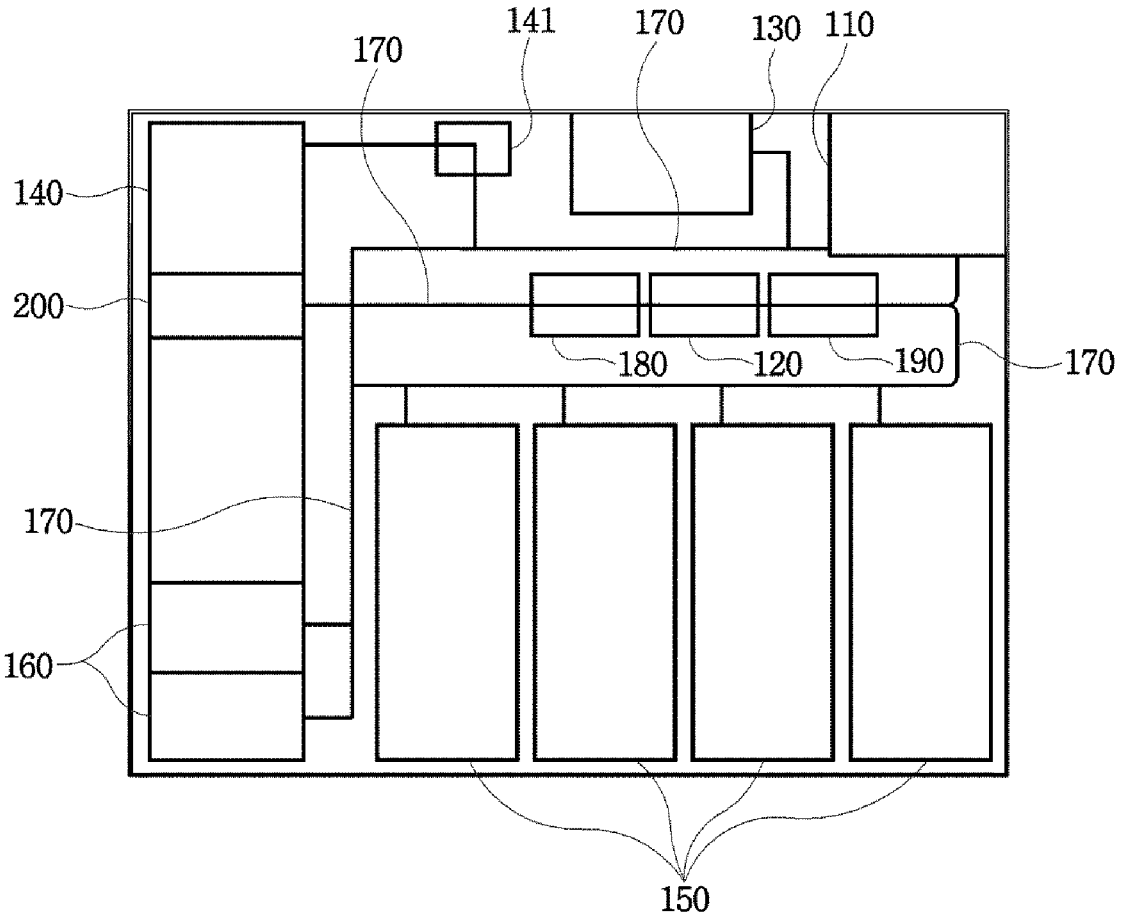
FIG. 3 is a view schematically showing an inner configuration of a circulation-type banknote/check deposit/withdrawal apparatus using a lateral deposit/withdrawal scheme according to an embodiment of the present invention.

FIG. 3 is a view schematically showing an inner configuration of a circulation-type banknote/check deposit/withdrawal apparatus using a lateral deposit/withdrawal scheme according to an embodiment of the present invention.

As shown in FIG. 3, the circulation-type banknote/check deposit/withdrawal apparatus using the lateral deposit/withdrawal scheme according to an embodiment of the present invention includes a deposit/withdrawal unit 110 for receiving banknotes and checks inserted thereinto or discharging banknotes to be withdrawn; a medium discrimination unit 120 for reading out and discriminating images of the banknotes and checks; a temporary storage unit 130 for temporarily storing the deposited banknotes and checks until a transaction thereof is established; a check cassette 140 for stacking the deposited checks; a plurality of banknote cassettes 150 for stacking the banknotes based on the respective types of the banknotes; a reject box 160 for recalling superimposed banknotes or severely damaged banknotes among banknotes discharged from the banknote cassettes 150; a carrying path 170 for laterally carrying the banknotes and checks to be deposited or withdrawn along a predetermined course; and a medium alignment unit 180 provided on the carrying path 170 so as to align the carrying positions of the laterally carried banknotes and checks on the carrying path with a predetermined alignment position.

In the circulation-type banknote/check deposit/withdrawal apparatus using the lateral deposit/withdrawal scheme of the present invention as described above, combinations of banknotes and checks of various sizes can be deposited and withdrawn through a single deposit/withdrawal unit; a carrying path is configured to carry the banknotes and checks deposited through the deposit/withdrawal unit in a lateral direction; and the carrying path is provided thereon with a medium alignment unit for aligning the carrying position on the carrying path of the banknotes and checks being carried thereon, so that the banknotes and checks, which have been deposited through the deposit/withdrawal unit and are being carried in the lateral direction, can be carried in a state where the banknotes and checks are aligned with a predetermined alignment position on the carrying path by the medium alignment unit, and stacked into respective corresponding cassettes.

In other words, if a banknote/check deposit/withdrawal apparatus of an ATM according to the related art were otherwise configured to simultaneously handle banknotes and checks of various sizes through a single deposit/withdrawal unit and to laterally carry the banknotes and checks on a carrying path, there would be problems in that the width of the carrying path should be inevitably increased in order to laterally carry all the banknotes and checks which are differently sized based on the types of the respective banknotes and checks and insertion slots of banknote and check cassettes for respectively stacking the banknotes and checks laterally carried along the carrying path should be also enlarged, leading to increases in the volume of the cassettes and hence the size of the ATM. Accordingly, the existing ATM employs a carrying path for carrying banknotes and checks in a longitudinal direction.

That is, in case of U.S.A. where banknotes and/or checks of various sizes are currently handled and used, the sizes of the handled banknotes are 156 mm×66 mm while the sizes of the handled checks are in a range of 150 mm×68 mm (personal checks) to 218 mm×91 mm (business checks). Accordingly, the width of the carrying path should be large to match with the sizes of the business checks such that all the banknotes and checks different from one another by up to 40% to 50% in size can be laterally carried on a single carrying path. Thus, it is highly likely that a skew or jam will occur during carrying of relatively small banknotes or personal checks.

Further, as the width of the carrying path is increased, the insertion slots of the banknote and check cassettes for respectively stacking the banknotes and checks are also larger than that of a conventional banknote cassette, resulting in problems of increase in the size of the ATM due to the increased size of the cassette and great difficulty in aligning the banknotes accumulated in the cassette with one another.

On the contrary, according to the present invention, a carrying path is configured to laterally carry banknotes and checks deposited through a deposit/withdrawal unit, and a medium alignment unit is provided on the carrying path so that the banknotes and checks carried in the lateral direction can be aligned with a predetermined alignment position on the carrying path, e.g., the center of the carrying path, and can be then stacked in respective corresponding cassettes, thereby optimizing the sizes of check and banknote cassettes based on respective corresponding media (banknotes and checks), minimizing the spaces occupied by the cassettes in the ATM to reduce the size of the ATM, and enhancing the carrying efficiency of the medium on the carrying path so as to increase the processing speed of the medium by employing the lateral deposit scheme.

Hereinafter, a configuration of the circulation-type banknote/check deposit/withdrawal apparatus using the lateral deposit/withdrawal scheme according to an embodiment of the present invention will be described in detail. First, the deposit/withdrawal unit 110 causes banknotes and checks, which have been inserted by a customer, to be sent therefrom through the carrying path 170 and upon withdrawal of banknotes, causes the banknotes come thereinto through the carrying path 170 to be discharged to a customer.

At this time, the carrying path 170 is configured to laterally carry banknotes and checks deposited or withdrawn through the deposit/withdrawal unit 110 along a predetermined course.

That is, the carrying path 170 is formed to have a width slightly larger than the lateral widths of the banknotes and checks to be handled so as to laterally carry the banknotes and checks. Since the lateral widths of checks are generally larger than those of banknotes, the carrying path 170 is formed to have a width larger by a certain amount than the lateral width of the widest check among all checks to be handled.

As shown in FIG. 3, the carrying path 170 formed as described above is configured to be connected from the deposit/withdrawal unit 110, through the medium discrimination unit 120 and the medium alignment unit 180, to the check cassette 140 and the temporary storage unit 130 arranged on an upper side of the banknote/check deposit/withdrawal apparatus as well as to the banknote cassettes 150 and the reject box 160 arranged on a lower side of the banknote/check deposit/withdrawal apparatus. As a laterally carrying scheme in which banknotes and checks are carried in a lateral direction is employed, the carrying efficiency may be improved as compared with a conventional deposit/withdrawal apparatus having a carrying path on which banknotes and checks are carried in a longitudinal direction. Accordingly, there is an advantage in that the processing speed of the medium can be increased.

The medium discrimination unit 120 is a device configured to discriminate media passing through the carrying path 170, i.e., banknotes and checks, and includes various sensors such as a length-detecting sensor, an image sensor, and a two-sheet detection unit.

The medium discrimination unit 120 configured as described above determines whether each of media (i.e., banknotes or checks) passing through the carrying path 170 consists of two sheets thereof. At the same time, the medium discrimination unit 120 further scans each of the media and then reads out an image thereof to determine whether the carried medium is a banknote or check. If it is determined that the carried medium is a check, information on the check such as the unique number of the check and the face value of the check read out of the check itself is transmitted to a high level controller (not shown). If it is determined that the carried medium is a banknote, the authenticity of the banknote, the type of the banknote, and the damaged state of the banknote are discriminated and the discrimination result is transmitted to the high level controller (not shown).

Here, the high level controller (not shown) determines whether the check is normal based on the check information, such as the unique number of the check and the face value of the check, transmitted from the medium discrimination unit 120.

At this time, the banknotes and checks laterally carried along the carrying path 170 are discriminated by means of the scanning in the process of discriminating the banknotes and checks by the medium discrimination unit 120 as described above, the time required to scan the banknotes and checks may be reduced as compared with that required by a medium discrimination unit of a conventional deposit/withdrawal apparatus in which checks are longitudinally carried and scanned to be discriminated.

Meanwhile, as shown in FIG. 3, a skew compensation unit 190 for compensating a skew of each of the banknotes or checks laterally carried through the deposit/withdrawal unit 110 may be provided upstream of the medium discrimination unit 120, i.e., between the medium discrimination unit 120 and the deposit/withdrawal unit 110 on the carrying path 170.

That is, if a medium (i.e., a banknote or check) laterally carried along the carrying path 170 is being carried slantly, the skew compensation unit 190 compensates a slant angle of the medium carried in the slanted state, so that the medium may be carried in a state where it is arranged perpendicularly to a carrying direction on the carrying path 170.

At this time, the skew compensation unit 190 may be composed of a pair of skew compensating rollers (not shown) that are rotated to each other with a time gap on the carrying path 170 to compensate the skew of the medium carried slantly. Since the skew compensating rollers (not shown) are known in the art, the detailed description thereof will be omitted.

Accordingly, the skew state of the banknote or check that has been deposited and is being carried through the deposit/withdrawal unit 110 may be correctly compensated by the skew compensation unit 190, and the compensated banknote/check may be then carried to the medium discrimination unit 120, so that the discriminating efficiency of the medium discrimination unit 120 may be increased in the process of discriminating the banknote or check.

Further, the medium alignment unit 180 for aligning a carrying position on the carrying path 170 on which the banknotes or checks passing through the medium discrimination unit 120 are carried laterally, with a predetermined alignment position is provided downstream of the medium discrimination unit 120.

At this time, the medium discrimination unit 120 is provided with a plurality of rollers for carrying banknotes and checks, which may deteriorate the aligned states of the carried banknotes or checks during passage thereof through the medium discrimination unit 120. Accordingly, it is preferable that the medium alignment unit 180 is provided downstream of the medium discrimination unit 120 so as to compensate the aligned states of the banknotes and checks passing through the medium discrimination unit 120.

Figure 4:
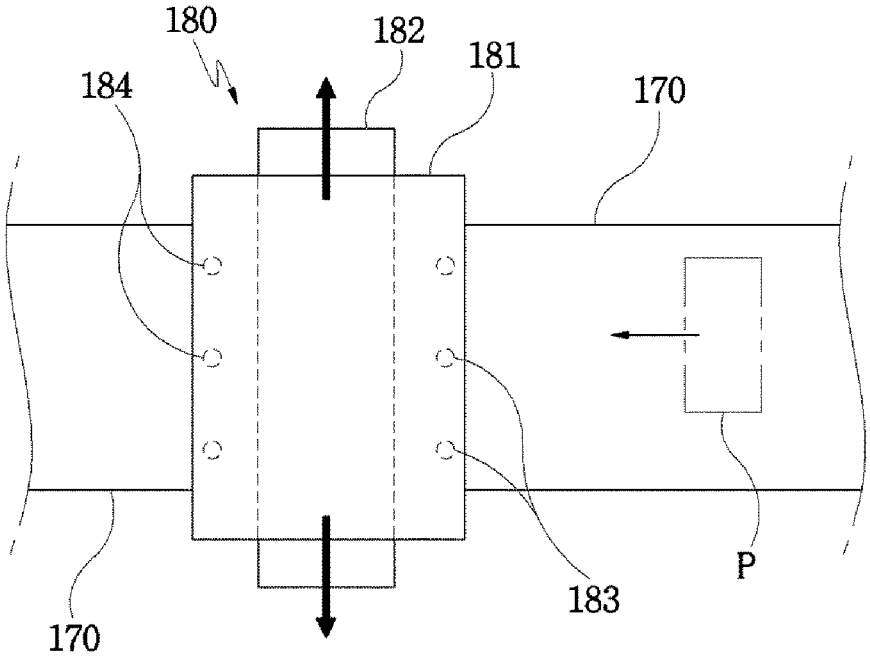
FIG. 4 is a view showing a configuration of a medium alignment unit provided in the banknote/check deposit/withdrawal apparatus according to the present invention.
Figure 5:
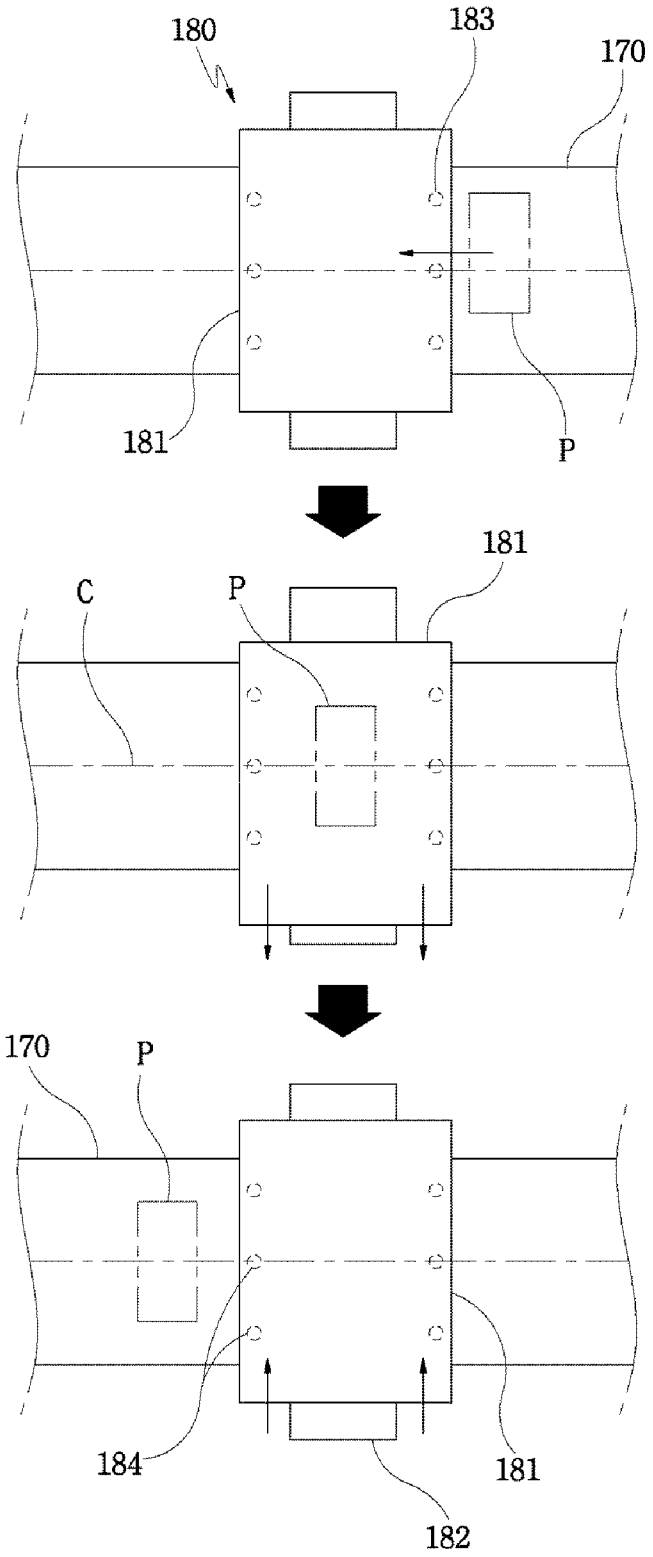
FIG. 5 is a view showing operating states of the medium alignment unit shown in FIG. 4.

FIG. 4 is a view showing a configuration of the medium alignment unit provided in the banknote/check deposit/withdrawal apparatus according to the present invention, and FIG. 5 is a view showing operating states of the medium alignment unit shown in FIG. 4.

As shown in FIG. 4, the medium alignment unit 180 is configured to include an alignment-type carrying path 181 that is integrally provided on the carrying path 170 to form a portion of the carrying path 170 and thus carries the banknotes or checks and that is provided to be movable perpendicularly to the carrying direction of the media (i.e., banknotes or checks); and a driving means 182 for moving the alignment-type carrying path 182 perpendicularly to the carrying direction of the banknotes and checks.

Here, the alignment-type carrying path 181 is formed as a portion of the carrying path 170 at a predetermined position of the carrying path 170 downstream of the medium discrimination unit 120, so that the alignment-type carrying path 181 may carry banknotes and checks to be carried along the carrying path 170. Further, the alignment-type carrying path 181 is provided to be movable perpendicularly (i.e., leftwards or rightwards) so that the alignment-type carrying path 181 may be moved leftwards or rightwards by the driving means 182.

Further, when banknotes or checks carried in an offset state enter the alignment-type carrying path 181, the driving means 182 causes the alignment-type carrying path 181 to be moved perpendicularly to the carrying direction of the media, based on the information on the carrying position on the carrying path 170 from the images of the banknotes or checks read out by the medium discrimination unit 120, so that the carried banknotes or checks may be carried in a state aligned with the center of the carrying path 170.

The driving means 182 described above may be composed of a combination of a driving motor and a gear, or a combination of a driving motor, a pulley and a belt, so as to cause the alignment-type carrying path 181 to be moved perpendicularly to the carrying direction of the media.

Further, an inlet sensor 183 for detecting whether each of the carried media (i.e., banknotes or checks) P enters the alignment-type carrying path 181 and an outlet sensor 184 for detecting whether each of the carried media P has passed the alignment-type carrying path 181 are provided on inlet and outlet sides of the alignment-type carrying path 181, respectively. Therefore, when each of the media P enters the alignment-type carrying path 181, the inlet sensor 183 may detect whether the medium enters the alignment-type carrying path 181, and when the medium has passed the alignment-type carrying path 181, the outlet sensor 184 may detect whether the medium has passed the alignment-type carrying path 181.

With the configuration, as shown in FIG. 5, when each of the media (i.e., banknotes or checks) P carried through the medium discrimination unit 120 enters the alignment-type carrying path 181, the inlet sensor 183 provided on the inlet side of the alignment-type carrying path 181 detects that the medium P enters the alignment-type carrying path 181. At this time, when the medium P carried in the offset state enters the alignment-type carrying path 181, the driving means 182 causes the alignment-type carrying path 181 to be moved perpendicularly to the carrying direction of the medium, based on the information on the carrying position on the carrying path 170 from the image of the medium P read out by the medium discrimination unit 120, so that the medium P carried on the alignment-type carrying path 181 can be carried in a state where the center of the medium P is aligned with the center C on the carrying path 170 downstream of the alignment-type carrying path 181. Then, if the outlet sensor 184 provided on the outlet side of the alignment-type carrying path 181 detects that the aligned medium has passed the alignment-type carrying path 181, the driving means 182 is driven such that the alignment-type carrying path 181 may return to its initial position.

At this time, aligning the centers of the banknotes or checks laterally carried through the medium alignment unit 180 with the center C on the carrying path 170 is to rapidly align various types of banknotes and checks having different lateral lengths.

That is, if a one-side aligning scheme in which one side end of each of the laterally carried banknotes or checks is aligned with one side position on the carrying path 170 is employed, a widthwise distance through which the alignment-type carrying path 181 is shifted in the process of aligning various banknotes and checks having different lengths is larger as compared with the center alignment scheme described above, resulting in more time required for alignment.

Meanwhile, as an alternative embodiment of the medium alignment unit, an alignment detection unit for detecting the aligned states of the media (i.e., banknotes or checks) laterally carried on the carrying path is provided instead of using the information on the positions of the media through the medium discrimination unit, so that the alignment-type carrying path can be moved based on the aligned states of the media detected by the alignment detection unit, thereby achieving the alignment of the carried media.

Figure 6:
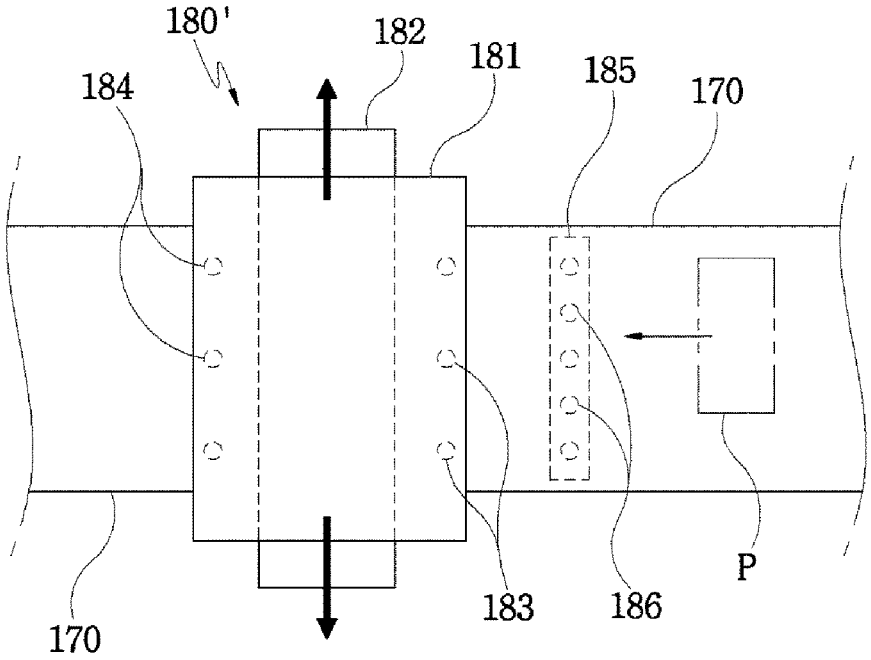
FIG. 6 is a view showing another exemplary configuration of the medium alignment unit provided in the banknote/check deposit/withdrawal apparatus of the present invention.
Figure 7:
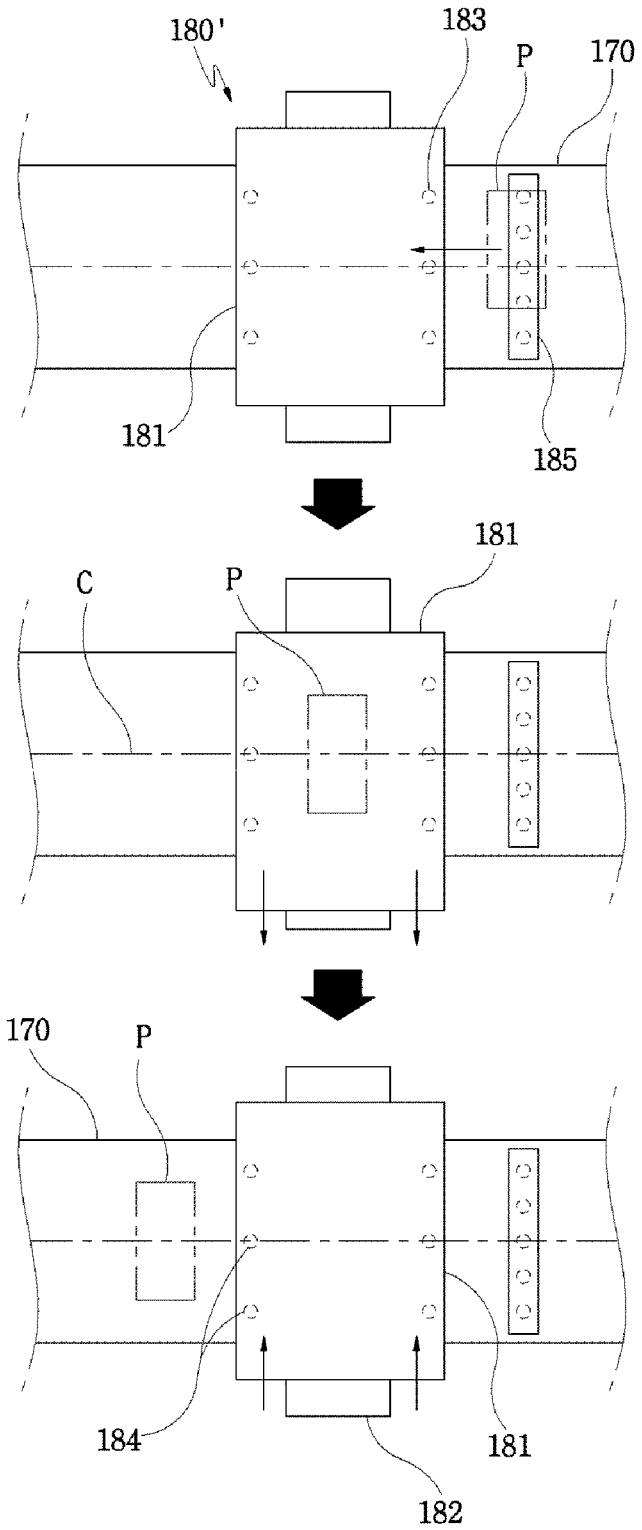
FIG. 7 is a view showing operating states of the medium alignment unit shown in FIG. 6.

FIG. 6 is a view showing another exemplary configuration of the medium alignment unit provided in the banknote/check deposit/withdrawal apparatus of the present invention, and FIG. 7 is a view showing operating states of the medium alignment unit shown in FIG. 6.

As shown in FIG. 6, a medium alignment unit 180' according to another embodiment of the present invention has an alignment detection unit 185 provided upstream of the alignment-type carrying path 181 to detect the aligned states of the laterally carried media (i.e., banknotes or checks) P, so that the carrying positions of the media P on the carrying path 170 carried through the alignment detection unit 185 can be detected.

At this time, the alignment detection unit 185 is composed of a plurality of detection sensors 186 arranged perpendicularly to the medium carrying direction over the carrying path 170 upstream of the alignment-type carrying path 181, so that the banknotes or checks carried in the offset state on the carrying path 170 can be detected.

That is, when each of the media P is carried toward the alignment-type carrying path 181 along the carrying path, if each of the media (i.e., banknotes or checks) P is not detected by only at least one detection sensor disposed on one or the other side among the plurality of detection sensors 186 that are arranged perpendicularly to the medium carrying direction, it is determined that the medium P is carried in the offset state.

With the configuration described above, as shown in FIG. 7, when each of the media (i.e., banknotes or checks) P carried through the medium discrimination unit 120 enters the alignment-type carrying path 181, the alignment detection unit 185 provided upstream of the alignment-type carrying path 181 detects the carrying position of the medium P, which is carried toward the alignment-type carrying path 181, on the carrying path 170. Together therewith, the inlet sensor 183 provided on the inlet side of the alignment-type carrying path 181 detects the entry of the medium P into the alignment-type carrying path 181. At this time, when each of the media P carried in the offset state enters the alignment-type carrying path 181, the driving means 182 causes the alignment-type carrying path 181 to be moved perpendicularly to the medium carrying direction based on the carrying position of the medium P on the carrying path 170 detected by the alignment detection unit 185, so that the carried medium P can be aligned to be carried along the center C on the carrying path 170. Then, when the outlet sensor 184 provided on the outlet side of the alignment-type carrying path 181 detects that the aligned medium has passed the alignment-type carrying path 181, the driving means 182 is driven such that the alignment-type carrying path 181 can return to its initial position.

Meanwhile, referring back to FIG. 3, a retract box 200 for temporarily storing rejected banknotes or checks, which have been discriminated as severely damaged banknotes, two superimposed sheets of banknotes or checks, counterfeit banknotes, or others except for normal banknotes or checks by the medium discrimination unit 120 in a deposit process through the deposit/withdrawal unit 110, and for returning the rejected banknotes or checks to a customer through the banknote deposit/withdrawal unit 110 may be connected to the carrying path 170 downstream of the medium discrimination unit 120 and the medium alignment unit 180.

The temporary storage unit 130 serves to temporarily store the banknotes or checks, which have been deposited and have passed the medium discrimination unit 120 and the medium alignment unit 180, until a deposit transaction of the banknotes or checks is established.

That is, the temporary storage unit 130 is provided downstream of the medium alignment unit 180 to temporarily store banknotes or checks aligned and carried by the medium alignment unit 180 until a transaction thereof is established, wherein the temporary storage unit 130 is configured to operate in a drum fashion by which carried banknotes or checks are wound and stored around a drum in their deposited sequence and the banknotes or checks wound around the drum are discharged in their wound sequence when a deposit transaction of the banknotes or checks is established by an approval of the customer.

The check cassette 140 is an accommodation space for stacking checks therein. The check cassette 140 is arranged above and connected to the carrying path 170 that is provided with the skew compensation unit 190, the medium discrimination unit 120 and the medium alignment unit 180 in the deposit/withdrawal apparatus. The check cassette 140 stacks deposited checks that have been discriminated as normal checks through the discrimination by the medium discrimination unit 120 and the high level controller (not shown).

At this time, a check printing unit 141 for printing deposit identification information such as customer account information, branch information and deposit date and time information on each of deposited checks may be provided on the carrying path 170 to be connected to the check cassette 140.

The plurality of banknote cassettes 150 are accommodation spaces for stacking banknotes therein. The banknote cassettes 150 are arranged below and connected respectively to the carrying path 170 that is provided with the skew compensation unit 190, the medium discrimination unit 120 and the medium alignment unit 180 in the deposit/withdrawal apparatus. The banknote cassettes 150 serve to perform a circulation function by stacking deposited banknotes discriminated as normal banknotes through the discrimination by the medium discrimination unit 120 based on the types of banknotes, and discharging the banknotes stacked in the banknote cassettes 150 through the medium discrimination unit 120 toward the deposit/withdrawal unit 110 upon withdrawal of the banknotes.

At this time, for the check cassette 140 and the plurality of banknote cassettes 150 described above, the widths of insertion slots of the cassettes 140 and 150 and the sizes of accommodation spaces of the cassettes 140 and 150 are determined based on lateral widths of banknotes or checks to be stacked in the cassettes 140 and 150. Accordingly, the sizes of the check cassette 140 and the banknote cassettes 150 may be optimally configured based on their corresponding banknotes or checks to be stacked therein.

The reject box 160 stores two superimposed sheets of banknotes or severely damaged banknotes among banknotes discharged from the banknote cassettes 150 in a withdrawal process of banknotes.

With the configuration described above, in the circulation-type banknote/check deposit/withdrawal apparatus using the lateral deposit/withdrawal scheme according to the present invention, banknotes and checks deposited through the deposit/withdrawal unit 110 are laterally carried along the carrying path 170, and the medium alignment unit 180 or 180' provided on the carrying path 170 carries the banknotes and checks in aligned states where the aligned positions of the banknotes and checks on the carrying path 170 are aligned with the center C of the carrying path 170. Accordingly, when the carried banknotes and checks are to be stacked in their corresponding banknote cassettes 150 and check cassette 140, the banknotes and checks can be always uniformly carried in the aligned states where they are aligned with the center C on the carrying path 170, and then stacked in their corresponding banknote cassettes 150 and check cassette 140. Thus, the sizes of the banknote cassettes 150 and the check cassette 140 may be optimally configured based on the widths of their corresponding banknotes and checks. As a result, there is an advantage in that the spaces occupied by the cassettes in the ATM can be reduced.

Hereinafter, procedures of handling banknotes and checks through the circulation-type banknote/check deposit/withdrawal apparatus using the lateral deposit/withdrawal scheme based on the configuration of FIGS. 3 to 5 as described above will be described.

Figure 8:
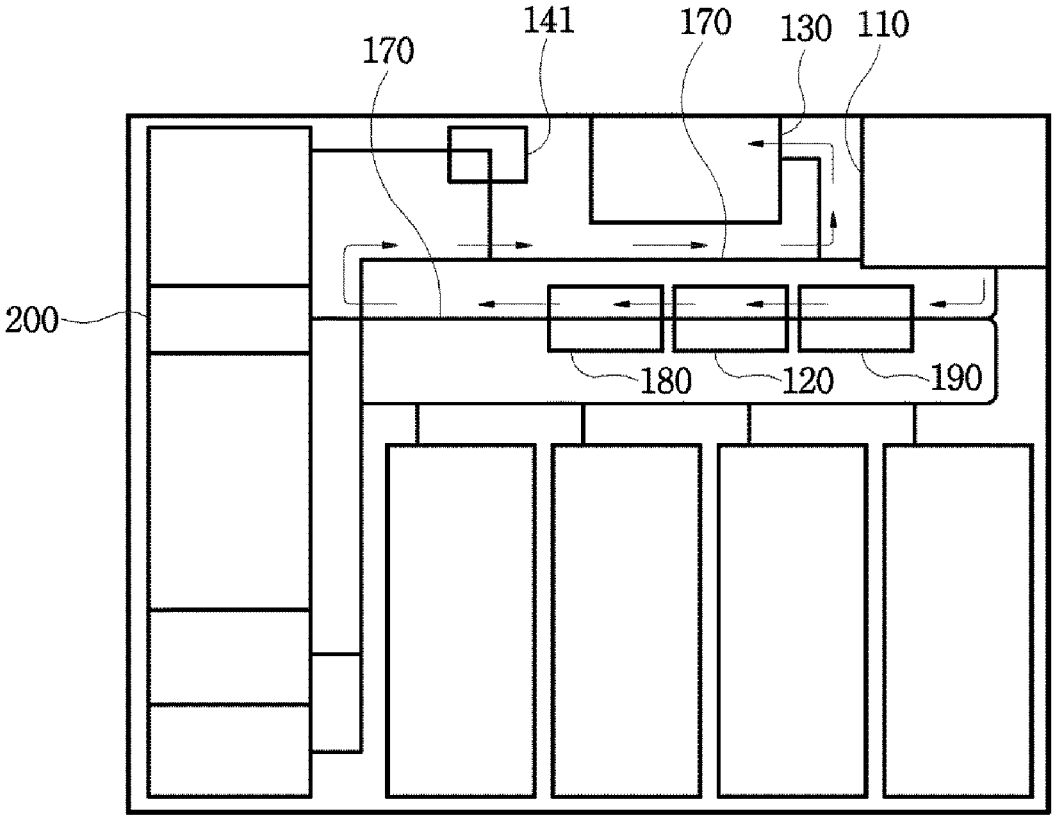
FIGS. 8 and 9 are views showing deposit-processing procedures of banknotes and checks in a circulation-type banknote/check deposit/withdrawal apparatus using a lateral deposit/withdrawal scheme according to another embodiment of the present invention.
Figure 9:
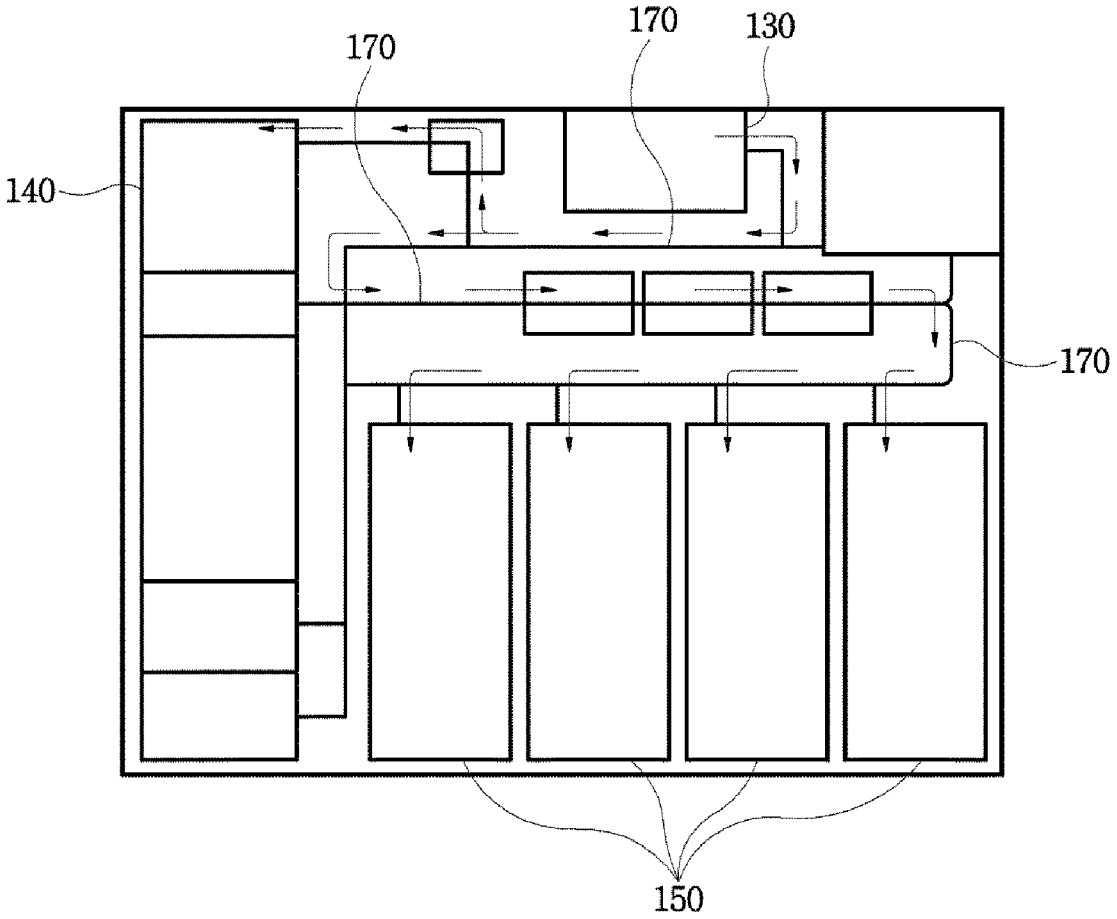

FIGS. 8 and 9 are views showing deposit-processing procedures of banknotes and checks in a circulation-type banknote/check deposit/withdrawal apparatus using a lateral deposit/withdrawal scheme according to another embodiment of the present invention.

As shown in FIG. 8, when a customer deposits mixed banknotes and checks, the banknotes and checks inserted through the deposit/withdrawal unit 110 by the customer are laterally carried along the carrying path 170 and then pass through the skew compensation unit 190, the medium discrimination unit 120 and the medium alignment unit 180 sequentially provided on the carrying path 170.

That is, the skew states of the banknotes and checks laterally carried from the deposit/withdrawal unit 110 are compensated during passage thereof through the skew compensation unit 190. Then, the discrimination of each of the banknotes and checks is performed during passage thereof through the medium discrimination unit 120. Thereafter, the carrying positions of the banknotes and checks on the carrying path 170 are aligned during passage thereof through the medium alignment unit 180.

Here, in the process of discriminating the banknotes and checks by the medium discrimination unit 120, the medium discrimination unit 120 determines whether the banknotes and checks laterally carried on the carrying path 170 are two superimposed sheets of banknotes and/or checks. At the same time, the medium discrimination unit 120 further determines whether each of the carried media is a banknote or check by scanning the banknote or check and reading out the image thereof. If the carried medium is a check, information on the check such as the unique number of the check and the face value of the check read out from the check is transmitted to a high level controller (not shown). If the carried medium is a banknote, the authenticity of the banknote, the type of the banknote, and the damaged state of the banknote are discriminated, and the result is then transmitted to the high level controller (not shown).

Further, as shown in FIGS. 4 and 5, for the banknotes and checks that have passed the medium discrimination unit 120 and are carried toward the medium alignment unit 180, the inlet sensor 183 provided on the inlet side of the alignment-type carrying path 181 detects entry of one of the banknotes or checks into the alignment-type carrying path 181 when the banknotes and checks are carried toward the alignment-type carrying path 181 of the medium alignment unit 180. At this time, if one of the banknotes or checks carried in an offset state enters the alignment-type carrying path 181, the driving means 182 causes the alignment-type carrying path 181 to be moved perpendicularly to the carrying direction of the medium based on information on a carrying position on the carrying path 170 from the image of the banknote or check read out by the medium discrimination unit 120, thereby allowing the banknote or check carried on the alignment-type carrying path 181 to be carried in a state where it is aligned with the center C on the carrying path 170 downstream of the alignment-type carrying path 181.

Further, when the outlet sensor 184 provided on the outlet side of the alignment-type carrying path 181 detects that the aligned banknote or check has passed the alignment-type carrying path 181, the driving means 182 can cause the alignment-type carrying path 181 to return to the initial position of the alignment-type carrying path 181, thereby enabling the alignment of the carrying position of the next banknote or check that will enter the alignment-type carrying path 181.

Thereafter, the banknote or check of which the carrying position has been aligned by the medium alignment unit 180 is carried along the carrying path 170 downstream of the medium alignment unit 180 and then stored in the temporary storage unit 130.

At this time, the temporary storage unit 130 is configured in the drum fashion, so that the banknotes or checks aligned and carried through the medium alignment unit 180 can be wound and stored around the drum in their deposited sequence and then the banknotes or checks wound around the drum are discharged in their wound sequence during discharge of the banknotes or checks. Since the banknotes or checks are discharged to the carrying path 170 while the aligned states of the banknotes or checks achieved by the medium alignment unit 180 are maintained as they are, the banknotes or checks discharged and carried from the temporary storage unit 130 can be carried in the state where they are aligned with the center on the carrying path 170.

Meanwhile, the banknotes or checks that have been superimposed or discriminated as abnormal banknotes or checks among the carried banknotes or checks that have passed the medium discrimination unit 120 are not carried to the temporary storage unit 130 but to the retract box 200 and temporarily stored in the retract box. The banknotes or checks temporarily stored in the retract box are returned to the customer through the deposit/withdrawal unit 110 according to a later return process.

When the process of returning the banknotes or checks discriminated as the superimposed banknotes or checks or the abnormal banknotes or checks is completed as described above and the deposit transaction is then confirmed by the customer, the mixed banknotes and checks stored in the temporary storage unit 130 are carried in the state aligned with the center of the carrying path 170, and the banknotes are stacked in respective ones of the banknote cassettes 150 while the checks are stacked in the check cassette 140, as shown in FIG. 9.

At this time, the banknote cassettes 150 and the check cassette 140 may be configured such that the sizes of the cassettes are optimized to match with their corresponding banknotes or checks, thereby reducing the spaces occupied by the cassettes in the ATM.

As described above, the circulation-type banknote/check deposit/withdrawal apparatus using a lateral deposit/withdrawal scheme according to the present invention is configured such that banknotes or checks inserted through the deposit/withdrawal unit are laterally carried along the carrying path and the laterally carried banknotes or checks are aligned on the carrying path by the medium alignment unit provided on the carrying path and then stacked into their corresponding cassettes. Thus, there are advantages that the sizes of check and banknote cassettes can be optimally configured based on their corresponding media (i.e., banknotes and checks), and the carrying efficiency of the media through the carrying path can be enhanced by using the lateral deposit scheme, thereby increasing the processing speed of the media as well as reducing the volume of the deposit/withdrawal apparatus.

Further, both banknotes and checks can be deposited or withdrawn at the same time though a single deposit/withdrawal unit, so that the internal structure of the ATM can be simplified. For the banknotes, the circulation thereof is enabled to improve the customer's convenience in use.

It will be apparent to those skilled in the art that various substitutions, modifications and changes can be made without departing from the spirit and scope of the invention defined by the appended claims. Therefore, the present invention is not limited to the aforementioned embodiments and the accompanying drawings.

What is claimed is:

1. A banknote/check deposit/withdrawal apparatus, comprising:

a deposit/withdrawal unit configured to receive banknotes and checks of differing sizes, the deposit/withdrawal unit further configured to discharge banknotes to be withdrawn, each of the banknotes and checks having two shorter edges and two longer edges connecting the two shorter edges;

a medium discrimination unit configured to capture an image of each of the banknotes and checks, the medium discrimination unit further configured to classify each of the banknotes and checks based on the captured image;

a check cassette configured to receive and stack the deposited checks received from the deposit/withdrawal unit;

a plurality of banknote cassettes configured to receive and stack the deposited banknotes received from the deposit/withdrawal unit based on the classification made by the medium discrimination unit; and a carrying path extending from the deposit/withdrawal unit to the check cassette and the plurality of banknote cassettes via the medium discrimination unit, each of the banknotes and checks received at the deposit/withdrawal unit placed on the carrying path having the two shorter edges parallel to a moving direction of the carrying path and two longer edges perpendicular to the moving direction of the carrying path, the carrying path comprising a medium alignment unit configured to align a center of each of the banknotes and checks with a center of the carrying path by moving each of the banknotes and checks in a direction parallel to the two longer edges by a distance determined by the image captured at the medium discrimination unit.

2. The banknote/check deposit/withdrawal apparatus as claimed in claim 1, wherein the medium alignment unit is provided downstream of the medium discrimination unit on the carrying path so as to align the center of each of the banknotes and checks with the center of the carrying path.

3. The banknote/check deposit/withdrawal apparatus as claimed in claim 2, wherein the medium alignment unit comprises:

an alignment-type carrying path integrally provided on the carrying path to form a portion of the carrying path and carrying the banknotes and checks, the alignment-type carrying path being configured to be movable perpendicularly to a carrying direction of the banknotes and checks; and an actuator configured to move the alignment-type carrying path in a direction perpendicular to the carrying direction of the banknotes and checks.

4. The banknote/check deposit/withdrawal apparatus as claimed in claim 3, wherein the medium alignment unit further comprises an alignment detection unit provided upstream of the alignment-type carrying path on the carrying path so as to detect the carrying positions of the banknotes and checks on the carrying path.

5. The banknote/check deposit/withdrawal apparatus as claimed in claim 4, wherein the alignment detection unit comprises a plurality of detection sensors arranged along a direction perpendicular to the carrying direction of the banknotes and checks on the carrying path, and the medium alignment unit drives the actuator based on the carrying positions of the banknotes and checks on the carrying path detected by the alignment detection unit such that the carrying positions of the banknotes and checks are compensated and aligned.

6. The banknote/check deposit/withdrawal apparatus as claimed in claim 3, wherein an inlet sensor for detecting whether the carried banknotes and checks enter the alignment-type carrying path is provided at an inlet of the alignment-type carrying path and an outlet sensor for detecting whether the banknotes and checks have passed the alignment-type carrying path are provided at an outlet of the alignment-type carrying path.

7. The banknote/check deposit/withdrawal apparatus as claimed in claim 1, further comprising a reject box for recalling superimposed banknotes or severely damaged banknotes among banknotes discharged from the banknote cassettes.

8. The banknote/check deposit/withdrawal apparatus as claimed in claim 1, wherein the temporary storage unit is provided downstream of the medium alignment unit so as to temporarily store the carried banknotes and checks aligned by the medium alignment unit until, and the temporary storage unit is configured in a drum fashion to cause the carried banknotes and checks to be wound and stored around a drum in their deposited sequence and cause the banknotes and checks wound around the drum to be discharged in their wound sequence upon discharge of the banknotes and checks.

9. The banknote/check deposit/withdrawal apparatus as claimed in claim 1, wherein the check cassette and the plurality of banknote cassettes have a width of an insertion slot of each of the cassettes and a size of an accommodation space of each of the cassettes determined based on lateral widths of the banknotes and checks to be stacked in the respective banknote cassettes and check cassette.

10. The banknote/check deposit/withdrawal apparatus as claimed in claim 1, wherein the banknote/check deposit/withdrawal apparatus is a circulation-type banknote/check deposit/withdrawal apparatus.

11. A banknote/check deposit/withdrawal apparatus, comprising:

a deposit/withdrawal unit configured to receive banknotes and checks of differing sizes, the deposit/withdrawal unit further configured to discharge banknotes to be withdrawn, each of the banknotes and checks having two shorter edges and two longer edges connecting the two shorter edges;

a medium discrimination unit configured to capture an image of each of the banknotes and checks, the medium discrimination unit further configured to classify each of the banknotes and checks based on the captured image;

a carrying path extending from the deposit/withdrawal unit to the check cassette and the plurality of banknote cassettes via the medium discrimination unit, each of the banknotes and checks received at the deposit/withdrawal unit placed on the carrying path having the two shorter edges parallel to a moving direction of the carrying path and two longer edges perpendicular to the moving direction of the carrying path, the carrying path comprising a medium alignment unit positioned downstream of the medium discrimination unit, the medium alignment unit configured to align a center of each of the banknotes and checks with a center of the carrying path by moving each of the banknotes and checks in a direction parallel to the two longer edges by a distance determined by the image captured at the medium discrimination unit;

a temporary storage unit positioned downstream of the medium discrimination unit on the carrying path so as to temporarily store the banknotes and checks aligned with the center of the carrying path;

a plurality of banknote cassettes for stacking the banknotes to be deposited or withdrawn, based on the respective types of the banknotes; and a check cassette for stacking the deposited checks;

wherein the plurality of banknote cassettes are arranged below the carrying path in the banknote/check deposit/withdrawal apparatus, and the check cassette is arranged above the carrying path in the banknote/check deposit/withdrawal apparatus.

12. The banknote/check deposit/withdrawal apparatus as claimed in claim 11, wherein the medium alignment unit comprises:

an alignment-type carrying path integrally provided on the carrying path to form a portion of the carrying path and carrying the banknotes and checks, the alignment-type carrying path being configured to be movable perpendicularly to a carrying direction of the banknotes and checks; and an actuator configured to move the alignment-type carrying path in a direction perpendicular to the carrying direction of the banknotes and checks.

13. The banknote/check deposit/withdrawal apparatus as claimed in claim 12, wherein the medium alignment unit further comprises an alignment detection unit provided upstream of the alignment-type carrying path on the carrying path so as to detect the carrying positions of the banknotes and checks on the carrying path.

14. The banknote/check deposit/withdrawal apparatus as claimed in claim 13, wherein the alignment detection unit comprises a plurality of detection sensors arranged along a direction perpendicular to the carrying direction of the banknotes and checks on the carrying path, and the medium alignment unit drives the actuator based on the carrying positions of the banknotes and checks on the carrying path detected by the alignment detection unit such that the carrying positions of the banknotes and checks are compensated and aligned.

15. The banknote/check deposit/withdrawal apparatus as claimed in claim 11, wherein the temporary storage unit is provided downstream of the medium alignment unit so as to temporarily store the carried banknotes and checks aligned by the medium alignment unit, and the temporary storage unit is configured in a drum fashion to cause the carried banknotes and checks to be wound and stored around a drum in their deposited sequence and cause the banknotes and checks wound around the drum to be discharged in their wound sequence upon discharge of the banknotes and checks.

16. The banknote/check deposit/withdrawal apparatus as claimed in claim 11, wherein the check cassette and the plurality of banknote cassettes have a width of an insertion slot of each of the cassettes and a size of an accommodation space of each of the cassettes determined based on lateral widths of the banknotes and checks to be stacked in the respective banknote cassettes and check cassette.

17. A method of handling banknotes and checks deposited in banknote/check deposit/withdrawal apparatus, comprising:

receiving banknotes and checks of differing sizes at a deposit/withdrawal unit, each of the banknotes and checks having two shorter edges and two longer edges connecting the two shorter edges;

discharge banknotes to be withdrawn from the deposit/withdrawal unit;

capturing an image of each of the banknotes and checks by a medium discrimination unit;

classifying each of the banknotes and checks based on the captured image at the medium discrimination unit;

receiving and stacking the deposited checks received from the deposit/withdrawal unit in a check cassette;

receiving and stacking the deposited the banknotes received from the deposit/withdrawal unit based on the classification made by the medium discrimination unit in a plurality of banknote cassettes;

transferring the banknotes and checks from the deposit/withdrawal unit to the check cassette or the plurality of banknote cassettes on a carrying path, each of the banknotes and checks received at the deposit/withdrawal unit placed on the carrying path having the two shorter edges parallel to a moving direction of the carrying path and two longer edges perpendicular to the moving direction of the carrying path; and aligning a center of each of the banknotes and checks with a center of the carrying path by moving each of the banknotes and checks in a direction parallel to the two longer edges by a distance determined by the image captured at the medium discrimination unit.

* * * * *